US009700076B2

(12) United States Patent
Xiang

(10) Patent No.: US 9,700,076 B2
(45) Date of Patent: Jul. 11, 2017

(54) ATOMIZER ASSEMBLY, ELECTRONIC CIGARETTE EQUIPPED WITH THE ATOMIZER ASSEMBLY, AND METHOD FOR ASSEMBLING THE ATOMIZER ASSEMBLY

(71) Applicant: Zhiyong Xiang, Guangdong (CN)

(72) Inventor: Zhiyong Xiang, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 678 days.

(21) Appl. No.: 14/099,270

(22) Filed: Dec. 6, 2013

(65) Prior Publication Data

US 2015/0083144 A1 Mar. 26, 2015

(30) Foreign Application Priority Data

Sep. 25, 2013 (CN) ..... 2013 2 0596244 A

(51) Int. Cl.
*A24F 47/00* (2006.01)

(52) U.S. Cl.
CPC ..... *A24F 47/008* (2013.01)

(58) Field of Classification Search
CPC .... A24F 47/002; A24F 47/004; A24F 47/006; A24F 47/008; A61M 15/0065
USPC ..... 131/328–329
See application file for complete search history.

(56) References Cited

U.S. PATENT DOCUMENTS 2,005,233 A * 6/1935 Martin ..... A24F 13/14 131/175
2011/0232654 A1* 9/2011 Mass ..... A61M 15/06 131/273

* cited by examiner

*Primary Examiner* — Joseph S Del Sole
*Assistant Examiner* — Mohamed K Ahmed Ali
(74) *Attorney, Agent, or Firm* — Tim Tingkang Xia, Esq.; Locke Lord LLP

(57) ABSTRACT

The disclosure discloses an atomizer assembly, an electronic cigarette equipped with such atomizer assembly and a method for assembling the atomizer assembly. Wherein, an atomizer assembly configured to be connected with a battery assembly to form an electronic cigarette comprises an atomizer base, wherein, the atomizer assembly further comprises a marking element sheathed on the atomizer base and fixedly connected to the atomizer base, and the marking element is configured to be twisted off when the electronic cigarette is used. In this way, users can judge whether the electronic cigarette has been used or not. Therefore, the using process of the electronic cigarette is more healthy and can avoid diseases transmitting reciprocally between different users.

7 Claims, 2 Drawing Sheets

ATOMIZER ASSEMBLY, ELECTRONIC CIGARETTE EQUIPPED WITH THE ATOMIZER ASSEMBLY, AND METHOD FOR ASSEMBLING THE ATOMIZER ASSEMBLY

CROSS-REFERENCE TO RELATED APPLICATIONS

This non-provisional application claims priority under 35 U.S.C. §119(a) on Patent Application No. 201320596244.1, filed in P.R. China on Sep. 25, 2013, the entire contents of which are hereby incorporated by reference.

FIELD OF THE INVENTION

The present invention relates to the technical field of electronic-heating technology, and more particularly relates to an atomizer assembly, an electronic cigarette equipped with the atomizer assembly and a method for assembling the atomizer assembly.

BACKGROUND OF THE UTILITY MODEL

At present, an electronic cigarette includes a suction nozzle for smoking. The suction nozzle may be an independent part, one end of an atomizer or the whole electronic cigarette. When users use the electronic cigarette, they can smoke with the suction nozzle after a switch of the electronic cigarette is turned on. The user can also directly smoke with the suction nozzle to generate smoking air flow in the electronic cigarette. In this situation, the electronic cigarette can sense the smoking air flow by an air flow sensor, and generate smoke in response to the smoking air flow. After the electronic cigarette is smoked, it can be putted into a cigarette box for the next use.

Because the electronic cigarette has no mark for indicating whether it has been used or not, it is difficult to judge whether the electronic cigarette has been used or not. When many users use a number of electronic cigarettes received in the same cigarette box, one of the electronic cigarettes may be shared by different users, which is unhygienic and may transmit disease. Moreover, even if the cigarette box is a special one, it is difficult to judge whether the electronic cigarettes received in the cigarette box has been used or not.

SUMMARY OF THE INVENTION

Aiming at the drawbacks in the prior art that it is difficult to judge whether the electronic cigarette has been used or not, an atomizer assembly that can be judged whether it has been used or not is provided in the disclosure. An electronic cigarette equipped with such atomizer assembly and a method for assembling the atomizer assembly are provided in this disclosure.

In one aspect, an atomizer assembly configured to be connected with a battery assembly to form an electronic cigarette is provided in the disclosure. The atomizer assembly comprises an atomizer base, wherein, the atomizer assembly further comprises a marking element sheathed on the atomizer base and fixedly connected to the atomizer base, and the marking element is configured to be twisted off when the electronic cigarette is used. The atomizer base defines a channel for enabling cigarette smoke to flow, the marking element is sheathed on at least one end of the atomizer base and seals the channel. The atomizer base comprises an outer sleeve and a connector, one end of the outer sleeve is connected to a connector configured for being connected with the battery assembly; the marking element includes an open end and a closed end; wherein, the open end is fixedly connected to either the outer sleeve or the connector. The marking element further comprises a marking body connected between the open end and the closed end; the marking body is cylinder-shaped and defines an accommodating space, the marking body comprises a connecting portion and an accommodating portion, the connecting portion extends in the direction toward the closed end to form the accommodating portion; the connecting portion is fixedly connected to either the outer sleeve or the connector and is twisted off under a twisting force.

In one embodiment, a suction nozzle is mounted on one end of the outer sleeve, and the suction nozzle is received in the accommodating space of the marking element.

In another embodiment, the connector is received in the accommodating space of the marking element.

Yet in another embodiment, the connector comprises an external electrode electrically connected to the battery assembly, and the connecting portion is fixedly connected to the external electrode. The connecting portion comprises a plurality of connecting ribs arranged along the circumferential direction of the marking element and an engaging ring connected to ends of all the connecting ribs that are remote from the accommodating part; an engaging groove for engaging with the engaging ring is defined in a part of the external electrode corresponding to the connecting portion, and the engaging groove extends along the circumferential direction of the external electrode. A recess is defined in a part of the inner surface of the engaging ring, and a protruding part shaped to match the recess is defined in a part of the engaging groove corresponding to the recess.

Yet in another embodiment, the plurality of connecting ribs are spaced from each other along the circumferential direction of the marking element.

Yet in another embodiment, a thickness of each connecting rib ranges from 0.15 mm to 0.5 mm.

In another aspect, an electronic cigarette is provided in this disclosure. The electronic cigarette comprises a battery assembly and an atomizer assembly connected to the battery assembly, wherein, the atomizer assembly comprises an atomizer base, wherein, the atomizer assembly further comprises a marking element sheathed on the atomizer base and fixedly connected to the atomizer base, and the marking element is configured to be twisted off when the electronic cigarette is used.

In one embodiment, the atomizer assembly comprises a first outer sleeve and the battery assembly comprises a second outer sleeve, the first outer sleeve and the second outer sleeve are formed integrally as one piece.

In another embodiment, the battery assembly is detachably connected to the atomizer assembly.

In further another embodiment, a method for assembling atomizer assembly is provided in this disclosure. The method comprising:

Step 1, providing an atomizer base;

Step 2, providing a marking element configured to be twisted off when the electronic cigarette is used;

Step 3, sheathing the atomizer base on the marking element, and fixedly connecting one end of the marking element to the atomizer base to connect the marking element with the atomizer base together.

In one embodiment, the step 3 comprises:

receiving a suction nozzle of the atomizer base into the marking element, using a closed end of the marking element to resist against an end face of the suction mouth; connecting an open end of the marking element with an external electrode connected to an outer sleeve; a marking body located between the closed end and the open end receiving the outer sleeve and the suction nozzle and sealing a channel located in the outer sleeve. Use an engaging ring of a connecting portion of the marking body to engage with an engaging groove of the external electrode, to connect the marking element with the outer sleeve together.

In another embodiment, the step 3 comprises:

receiving a connector of the atomizer base in the marking element, using the closed end of the marking element to resist against an end face of the connector of the atomizer assembly; fixedly connecting an open end of the marking element to an external electrode connected to an outer sleeve; a marking body located between the closed end and the open end receiving the outer sleeve and the connector and sealing a channel located in the outer sleeve. Use an engaging ring of a connecting portion of the marking body to engage with an engaging groove of the external electrode to connect the marking element with the outer sleeve together.

When implementing this disclosure, the following advantages can be achieved:

In this disclosure, the atomizer assembly is provided with a marking element. When users use an electronic cigarette equipped with such atomizer assembly, they need to twist off the making means. In such case, the marking element can be regarded as a mark for judging whether the electronic cigarette has been used or not. Therefore, the using process of the electronic cigarette is more healthy and can avoid diseases transmitting reciprocally between different users. Moreover, because the atomizer assembly is sheathed on the marking element, the electronic cigarette equipped with the atomizer assembly has a compact structure and high stability. Furthermore, the marking element can also provide protection and dustproof effect to the electronic cigarette equipped with the atomizer assembly.

BRIEF DESCRIPTION OF THE DRAWINGS

The present disclosure can be further illustrated by reading the example with references made to the accompanying drawings, in which.

DETAILED DESCRIPTION OF THE PREFERRED EMBODIMENT

In this disclosure, the atomizer assembly is provided with a marking element. When users use an electronic cigarette equipped with such an atomizer assembly, they must twist off the making means. In such case, the marking element can be regarded as a mark for judging whether the electronic cigarette has been used or not. Therefore, the using process of the electronic cigarette is more healthy and can avoid diseases transmitting reciprocally between different users. Moreover, because the atomizer assembly is sheathed on the marking element, the electronic cigarette equipped with the atomizer assembly has a compact structure and high stability. Furthermore, the marking element can also provide protection and dustproof effect to the electronic cigarette equipped with the atomizer assembly.

Figure 1:
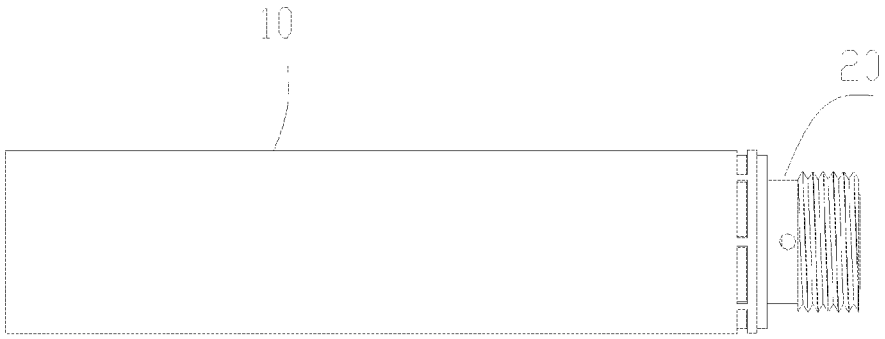
FIG. 1 is a structural schematic view of an atomizer assembly in accordance with one embodiment of the disclosure.
Figure 2:
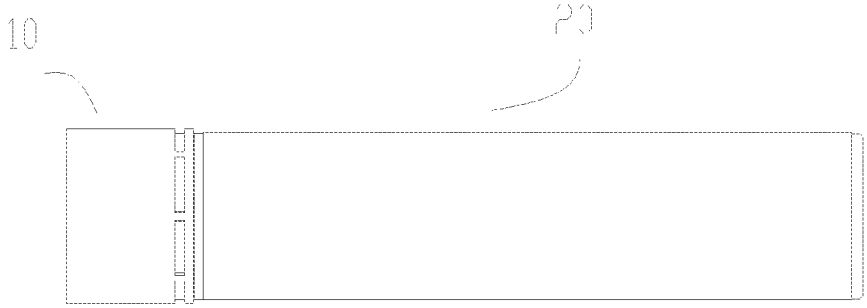
FIG. 2 is a structural schematic view of an atomizer assembly in accordance with another embodiment of the disclosure.

As shown in FIG. 1 and FIG. 2, a structural schematic view of the atomizer assembly in accordance of a first embodiment of the disclosure and a structural schematic view of the atomizer assembly in accordance of a second embodiment of the disclosure are respectively shown. In each of the two embodiments, the atomizer assembly comprises an assembly base 20 and a marking element 10. The marking element 10 is sheathed on the atomizer base 20, and is fixedly connected with the atomizer base 20. When users use the electronic cigarette, they need to twist off the marking element 10 to separate the marking element 10 from the atomizer base 20. Therefore, the marking element 10 can be used to judge whether the electronic cigarette equipped with the atomizer assembly has been used or not.

Figure 3:
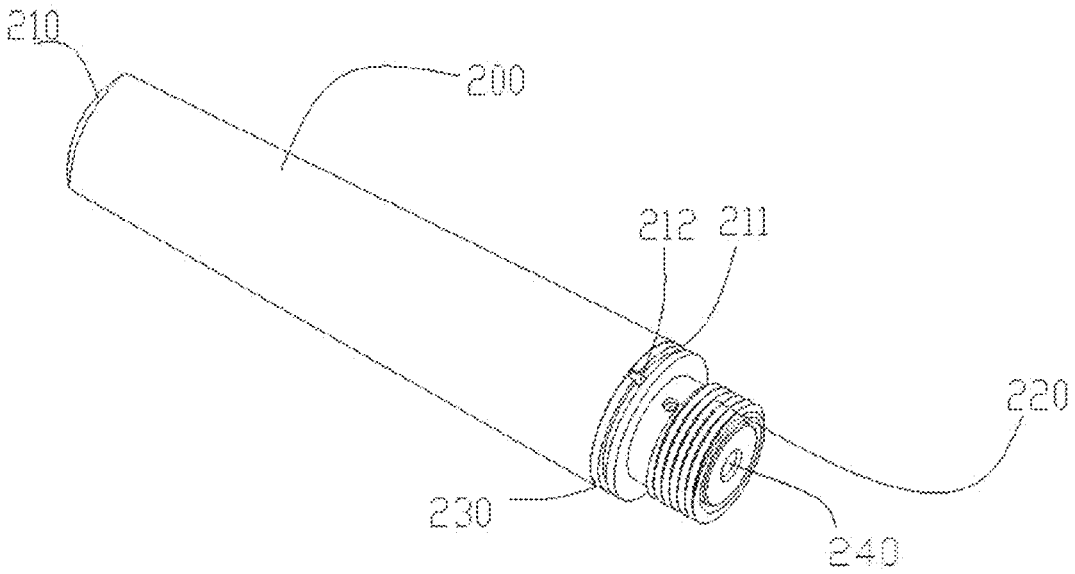
FIG. 3 is a structural schematic view of an atomizer base of the atomizer assembly shown in FIG. 1.

FIG. 3 shows a structural schematic view of the atomizer base 20. The atomizer base 20 comprises an outer sleeve 200, a suction nozzle 210 mounted on one end of the outer sleeve 200, and a connector 220 configured to be connected with a battery assembly of the electronic cigarette. The connector 220 is mounted on another end of the outer sleeve 200. The connector 220 is provided with an external electrode 230 inserted into the end of the outer sleeve 200. The outer sleeve 200 is substantially hollow circular truncated cone shaped. The cross sectional area of the outer sleeve 200 gradually increases from the suction nozzle 210 to the connector 220. The outer sleeve 200 defines a channel (240) for enabling cigarette smoke to flow. The channel communicates with the connector 220 and the suction nozzle 210. The marking element 10 is sheathed on at least one end of the outer sleeve 200 and seals the channel 240 to prevent the cigarette smoke from flowing out. An engaging groove 211 is defined in a part of the outer surface of the external electrode 230 for engaging with the marking element 10.

Figure 4:
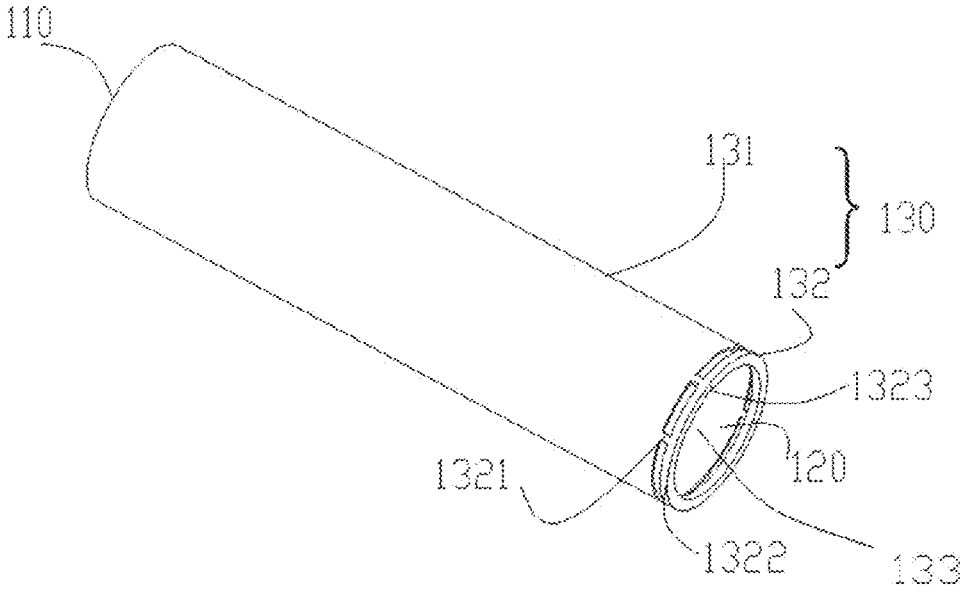
FIG. 4 is a structural schematic view of a marking element shown in FIG. 1.

FIG. 4 shows a structural schematic view of the marking element 10. The marking element 10 is hollow cylinder shaped. The marking element 10 includes an open end 120, a closed end 110, and a marking body 130 connected between the open end 120 and the closed end 110. The marking body 130 has an accommodating space (133), which is configured for receiving a part of the assembly base 20 while being assembled with the assembly base 20. Specifically, in one aspect, if one end of the outer sleeve 200 where the suction nozzle 210 is mounted is received in the marking element 10, a part of the outer sleeve 200 and the suction nozzle 210 are received in the accommodating space of the marking body 130. Preferably, the end face of the suction nozzle 210 is resisted against the inner side of the closed end 110 of the marking element 10. In another aspect, if another end of the outer sleeve 200 where the connector 220 is mounted is received in the marking element 10, a part of the outer sleeve 200 and the connector 220 are received in the accommodating space 133 of the marking body 130 of the marking element 10. Preferably, the end face of the connector 220 is resisted against the inner side of the closed end 110 of the marking element 10.

The marking body 130 further includes a connecting portion 132 and an accommodating portion 131. The connecting portion 132 extends toward the closed end 110 to form the accommodating portion 131. The marking element 10 is fixedly connected to the atomizer base 20 through the connecting portion 132. When users use the electronic cigarette equipped with the atomizer assembly, they need to apply twisting force to the connecting portion 132 to twist off the connecting portion 132.

In Specific, the connecting portion 132 includes a plurality of connecting ribs 1321 arranged along the circumferential direction of the marking element 10 and an engaging ring 1322 connected to ends of all the connecting ribs 1321 that are remote from the accommodating portion 131. The engaging ring 1322 is engaged with the engaging groove 211 defined in the part of the outside surface of the external electrode 230 corresponding to the connecting portion 132. The engaging groove 211 extends along the circumferential direction of the external electrode 230 and is provided around the external electrode 230. The engaging groove 211 is shaped to match the engaging ring 1322, so that an interference fit can be formed between the engaging ring 1322 and the engaging groove 211 to fixedly engage the engaging ring 1322 with the engaging groove 211. When users use the electronic cigarette, the marking element 10 should be twisted off. In this embodiment, the connecting ribs 1321 can be twisted off under twisting force. In another embodiment, the marking element 10 and the outer sleeve 200 are formed integrally, and the marking element 10 is connected with the outer sleeve 200 by the connecting ribs 1321. In another embodiment, the marking element 10 is attached to the atomizer base 20 by welding, gluing, or the like. In such cases, the marking element 10 can also be twisted off under twisting force. The connection between the marking element 10 and the atomizer base 20 can be selected according to the material of the marking element 10. Preferably, the marking element 10 can be made of polyvinylchloride, polycarbonate, polypropylene, or the like. An interference fit can be formed between the connecting portion 132 and the atomizer base 20 to connect the connecting portion 132 with the atomizer base 20.

To avoid slipping generated between the marking element 10 and the atomizer base 20 while twisting off the marking element 10, a recess 1323 is defined in a part of the inside surface of the engaging ring 1322 of the marking element 10. The recess 1323 is connected to one of the connecting ribs 1321. The width of the recess 1323 is equal to each connecting rib 1321. A protruding part 212 is defined in a part of the engaging groove 211 of the external electrode 230 corresponding to the recess 1323. The protruding part 212 is shaped to match the recess 1323. While assembling, the protruding part 212 is engaged with the recess 1323 to prevent the slipping while twisting off the marking element 10.

In order to be more convenient for twisting off the connecting ribs 1321, the thickness of each connecting rib 1321 is designed to range from 0.15 mm to 0.5 mm; and preferably, range from 0.15 mm to 0.2 mm.

In order to be more convenient for twisting off the marking element 10, the connecting ribs 1321 are arranged along the circumferential direction of the marking element 10 and are spaced from each other. A gap is formed between every two adjacent connecting ribs 1321. The widths of all the gaps can be equal, and can also be different from each other.

The shape of each connecting rib 1321 may be square, round, oval, triangle, etc.

An electronic cigarette is also provided by the disclosure. The electronic cigarette includes the aforementioned atomizer assembly and a battery assembly. In one embodiment, the atomizer assembly comprises a first outer sleeve and the battery assembly comprises a second outer sleeve, and the first outer sleeve and the second outer sleeve are formed integrally. In the other embodiment, the battery assembly is detachably connected to the atomizer assembly. The battery assembly is the same as that in the prior art, and does not need to be described in detail.

A method for assembling the atomizer assembly is also provided by this disclosure. The method comprises the following steps:

Step 1, providing a atomizer base 20; Step 2, providing a marking element 10 configured to be twisted off when the electronic cigarette is used;

Step 3, sheathing the atomizer base 20 on the marking element 10, and fixedly connecting one end of the marking element 10 to the atomizer base 20 to connect the marking element 10 with the atomizer base 20 together.

In one embodiment, during the step 3, a suction nozzle 210 of the atomizer base 20 is received in the marking element 10. A closed end 110 of the marking element 10 resists against an end face of the suction nozzle 210. An open end 120 of the marking element 10 is connected with an external electrode 230 connected to an outer sleeve 200. A marking body 130 located between the closed end 110 and the open end 120 receives the outer sleeve 200 and the suction nozzle 210 and seals a channel 240 defined in the outer sleeve 200. An engaging ring 1322 of a connecting portion 132 of the marking body 130 is engaged with an engaging groove 211 of the external electrode 230 to connect the marking element 10 with the outer sleeve 200 together.

In another embodiment, during the step 3, a connector 220 of the atomizer base 20 is received in the marking element 10. The closed end 110 of the marking element 10 resists against an end face of the connector 220 of the atomizer base 20. An open end 120 of the marking element 10 is connected to an external electrode 230 connected to an outer sleeve 200. A marking body 130 located between the closed end 110 and the open end 120 receives the outer sleeve 200 and the connector 220 and seals a channel 240 defined in the outer sleeve 200. An engaging ring 1322 of a connecting portion 132 of the marking body 130 is engaged with a engaging groove 211 of the external electrode 230 to connect the marking element 10 with the outer sleeve 200 together.

While the present invention has been described by reference to preferred embodiments, it will be understood by those skilled in the art that various changes may be made and equivalents may be substituted without departing from the scope of the present invention. However, all the changes will be included within the scope of the appended claims.

What is claimed is:

1. An atomizer assembly, configured to be connected with a battery assembly to form an electronic cigarette, the atomizer assembly comprising an atomizer base, wherein, the atomizer assembly further comprises a marking element sheathed on the atomizer base and fixedly connected to the atomizer base, and twisting of the marking element is indicating that the electronic cigarette has been used;

wherein the atomizer base comprises an outer sleeve and a connector, one end of the outer sleeve is connected to the connector configured for connecting with the battery assembly; the marking element includes an open end and a closed end; wherein, the open end is fixedly connected to either the outer sleeve or the connector;

wherein the marking element further comprises a marking body connected between the open end and the closed end; the marking body is cylinder-shaped and defines an accommodating space, the marking body comprises a connecting portion and the connecting portion extends in a direction toward the closed end to form an accommodating portion; the connecting portion is fixedly connected to either the outer sleeve or the connector and is capable of being twisted off under a twisting force;

wherein the connector comprises an external electrode configured to be electrically connected with the battery assembly, and the connecting portion is fixedly connected to the external electrode; and wherein the connecting portion comprises a plurality of connecting ribs arranged along a circumferential direction of the marking element and an engaging ring connected to all ends of the connecting ribs that are remote from the accommodating portion; an engaging groove for engaging with the engaging ring is defined in a part of the external electrode corresponding to the connecting portion, and the engaging groove extends along in a circumferential direction of the external electrode.

2. The atomizer assembly of claim 1, wherein, the atomizer base defines a channel enable cigarette smoke to flow, and the marking element is sheathed on at least one end of the atomizer base and seals the channel.

3. The atomizer assembly of claim 1, wherein, a suction nozzle is mounted on one end of the outer sleeve, and the suction nozzle is received in the accommodating space of the marking element.

4. The atomizer assembly of claim 1, wherein, the connector is received in the accommodating space of the marking element.

5. The atomizer assembly of claim 1, wherein, a recess is defined in an inner surface of the engaging ring, and a protruding part shaped to match the recess is defined in a part of the engaging groove corresponding to the recess.

6. The atomizer assembly of claim 1, wherein, the plurality of connecting ribs are spaced from each other along the circumferential direction of the marking element.

7. The atomizer assembly of claim 1, wherein, a thickness of each connecting rib ranges from 0.15 mm to 0.5 mm.

* * * * *